United States Patent [19]

Karmarkar et al.

[11] Patent Number: 5,025,849

[45] Date of Patent: Jun. 25, 1991

[54] CENTRIFUGAL CASTING OF COMPOSITES

[75] Inventors: Subhash D. Karmarkar, Great Falls; Amarnath P. Divecha, Falls Church, both of Va.

[73] Assignee: The United States of America as represented by the Secretary of the Navy, Washington, D.C.

[21] Appl. No.: 436,847

[22] Filed: Nov. 15, 1989

[51] Int. Cl.[5] ..... B22D 19/14; B22D 23/00

[52] U.S. Cl. ..... 164/97; 164/91

[58] Field of Search ..... 164/97, 100, 101, 102, 164/94, 95, 900

[56] References Cited

U.S. PATENT DOCUMENTS

| | | | |
|---|---|---|---|
| 4,117,580 | 10/1978 | Heck | 164/100 |
| 4,211,269 | 7/1980 | Bentz et al. | 164/94 |
| 4,279,289 | 7/1981 | Ban et al. | 164/97 |
| 4,617,979 | 10/1986 | Suzuki | 164/97 |
| 4,631,793 | 12/1986 | Shintaku et al. | 164/97 |
| 4,916,030 | 4/1990 | Christodoulou | 148/405 |

FOREIGN PATENT DOCUMENTS

| | | | |
|---|---|---|---|
| 3444406 | 6/1086 | Fed. Rep. of Germany | 164/97 |
| 51-035563 | 10/1976 | Japan | 164/97 |
| 58-6769 | 1/1983 | Japan | 164/97 |
| 58-144441 | 8/1983 | Japan | 164/97 |
| 59-023833 | 2/1984 | Japan | 164/97 |
| 61-038765 | 2/1986 | Japan | 164/97 |
| 61-202769 | 9/1986 | Japan | 164/97 |
| 62-176662 | 8/1987 | Japan | 164/97 |
| 685429 | 9/1979 | U.S.S.R. | 164/97 |
| 1013080 | 4/1983 | U.S.S.R. | 164/97 |

*Primary Examiner*—Richard K. Seidel
*Assistant Examiner*—Rex E. Pelto
*Attorney, Agent, or Firm*—Kenneth E. Walden

[57] ABSTRACT

Tubes or other symmetrical shapes are formed of composite materials, such as silicon carbide and aluminum, by spin casting. The reinforcing material can be precast into a billet or bar of the matrix metal, remelted and introduced into a spinning mold. Tubes can be produced with walls having differing amounts of reinforcing materials in the tube wall. Castings can be obtained having a uniform distribution of a reinforcement in a matrix metal.

13 Claims, 2 Drawing Sheets

CENTRIFUGAL CASTING OF COMPOSITES

FIELD OF THE INVENTION

The present invention relates in general to a centrifugal casting process and, more particularly, to a process of centrifugal or spin casting of tubes and other shapes of composite materials.

PRIOR ART

Reinforced metal composites have a number of advantages over conventional unreinforced metal structures, including greater strength, high specific stiffness, dimensional stability, and structural integrity. Composites such as silicon carbide/aluminum have been fabricated into tubular shapes by hot pressing, P/M billets, extrusion, back extrusion, and by sheer spinning. However, these processes are tedious and labor intensive.

It is known from U.S. Pat. No. 4,060,412 to mix microscopic fibers of silicon carbide or graphite with a metal powder, such as aluminum, and subject the powder mixture to pressure and heat to form a fiber/reinforced metal composite.

It is also known from U.S. Pat. No. 3,941,181 that a hard-faced metal roller can be produced by first introducing tungsten carbide ceramic particles into a rotating cylindrical mold, e.g., a centrifugal casting machine, and then injecting molten metal into the mold at a temperature below the melting temperature of the particles. This results in a cast roller having practically all of the ceramic particles on the outer surface of the roller.

It is known that gravity casting of a tube or a shape of a composite material will not result in a casting having a uniform distribution of the reinforcement in the matrix because of the density differences and the melt viscosity.

It also known to centrifugally cast tubes from unreinforced molten metal. Composite tubes have also been made by centrifugally forcing molten metal to infiltrate tubular ceramic preforms.

It is desirable to have an economical process for producing tubes of reinforced composite material in which the reinforcing material is more evenly distributed in the wall of the tube. It is also desirable to have a process for producing a tube in which the tube wall can be formed of layers of different materials.

SUMMARY OF THE INVENTION

A process is provided for spin casting metal composites to form tubes or other shapes. A molten mixture comprising a reinforcing material, such as silicon carbide, and a matrix metal, such as aluminum, is introduced into a horizontal or vertical cylindrical or symmetrical mold in a centrifugal casting machine. In a preferred aspect of the invention, the reinforcing material is selectively mixed with the matrix metal as it is poured into the spinning mold. In this way, tubes or other shapes be produced with differing amounts of reinforcement in any desired area of the tube wall. Castings can be obtained having a uniform distribution of reinforcement in a metal matrix.

BRIEF DESCRIPTION OF THE DRAWINGS

Various other objects, features, and attendant advantages of the present invention will be more fully appreciated as the same becomes better understood when considered in conjunction with the accompanying drawings, in which like reference characters designate the same or similar parts throughout the several views and wherein.

DETAILED DESCRIPTION OF THE INVENTION

Figure 1:
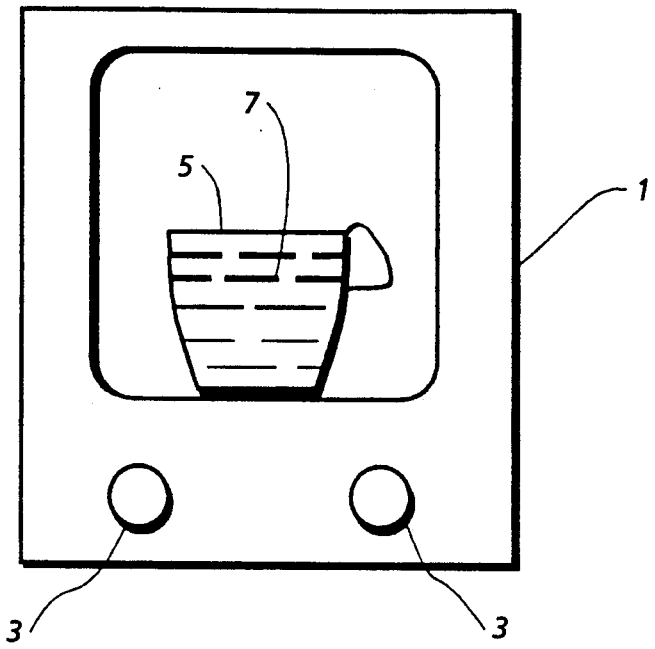
FIG. 1 is a cross-sectional view of the furnace used in remelting a billet or bar of composite material to be cast.

According to the process of the present invention, a molten composite containing reinforcing material can be introduced directly into a mold which can have a cylindrical or other shape which is preferably symmetrical. As the mold rotates, the reinforcing material tends to migrate through the molten matrix metal toward the surface of the mold, i.e., the outer surface of the cast tube wall. This is particularly true when thin wall tubes are being cast and also when there is a slower rate of solidification of the molten metal. In a preferred embodiment, the reinforcing material is pressure-injected or sprayed in measured quantities into the thin stream of molten matrix metal as it being poured into the mold. In this embodiment, the tube wall can be poured slowly layer by layer, with each layer containing a desired amount of reinforcing material. Since, in casting a thin walled tube, there is less time for the particles to migrate due to centrifugal forces and less time for matrix metal and reinforcing materials to interact, thin wall tubes produced according to the present invention were found to have a more even distribution of reinforcing material in the tube wall.

In another preferred embodiment, the first poured outer layers of the tube can be formed on only the matrix metal, e.g., aluminum; an inner layer can be reinforced with, for example, silicon carbide; and the inner layer can be formed without any reinforcing material. This procedure is preferred where it is desired to avoid machining the inner tube surfaces, since unreinforced inner layers are generally smoother.

When a billet, bar, or pig of the composite is to be used as a starting material, it is preferred to melt, under an argon blanket, stir, and pour the mixture into a spinning mold purged with argon as rapidly as possible. The time during which the mixture is molten is preferably kept to a minimum to avoid any undesired reactions between the reinforcing materials and the matrix metal, or the dissolution of the reinforcing material in the molten metal. If the mixture remains molten for too long a time, the reinforcement, i.e., silicon carbide, reacts with the molten aluminum to form aluminum carbide. The presence of these reaction products was discovered by optical micrographs and by chemical analysis.

Although any type of furnace can be used in melting the composite mixture, an induction furnace or a swing coil furnace is preferred for melting a billet, bar, or pig of the composite material, since these types of furnaces quickly melt the metal and also stir the mixture during the melting process. The composite mixture to be cast can also be prepared by stirring reinforcing material into the molten matrix metal. The process of the present invention can be used to produce any size of reinforced tubes from any melt-stable ceramic particles/matrix metal composites at a small fraction of the cost of producing composite tubes according to prior art methods.

In another preferred embodiment, ceramic reinforcing particles are sprayed or injected directly into the matrix metal as it is introduced into the mold. Preferably, the particles being introduced contact the molten matrix metal before it reaches the molten surface. It is known that the ceramic particles tend to concentrate on the inner wall of the mold due to centrifugal forces. By controlling the rotational speed of the mold, the temperature of the molten matrix metal, and the rate of cooking, i e , rate of solidification of the matrix metal, tubes can be produced having differential concentrations of ceramic reinforcing materials in the tube wall.

Although any type of reinforcing materials can be used in the process of the present invention, preferred reinforcing materials are silicon carbide, boron carbide, titanium carbide, graphite, alumina, silicon nitride, and combinations thereof. These reinforcing materials can be of any size or shape. However, with finer particles of reinforcing materials, there is a greater likelihood of a reaction at their interface. It is preferred to use whiskers and particles of silicon carbide having an average size of from about 5 $\mu$ to 20 $\mu$ microns. Some of these reinforcing materials are preferably coated to prevent reaction of the reinforcing material with the molten metal matrix. Such protective coatings are also preferred to avoid dissolution of the ceramic particles into the molten metal. Preferred protective coating materials include copper, molybdenum, hafnium, or silver, with copper and silver being more preferred. For example, it is preferred to coat the silicon carbide particles with copper or silver to minimize reaction with a matrix metal of aluminum or magnesium. The reinforcing materials can also be coated to increase wetting of either surface by the matrix metal.

The reinforcing material preferably comprises form about 7 to 40, more preferably 10 to 20, percent by volume of the cast metal. It has been found that tubes containing substantially more than about 20 percent by volume of the reinforcing material can be very brittle.

In the process of the present invention, tubes can be formed of aluminum with silicon carbide reinforcement, copper- or nickel-based superalloys reinforced with titanium carbide, nickel-based superalloys reinforced with alumina, aluminum or magnesium reinforced with graphite, silicon carbide, or boron carbide.

To avoid adhesion of the cast tube to the mold surface, it is preferred to apply a mold release material to the surface of the mold. Preferred mold release materials are alumina wash or graphite wash. Graphite is most preferred because it has better heat retention, thereby preventing heat loss from the heated mold before the molten metal is introduced. The thickness of the mold release agent coating can vary, depending upon the metal being cast. It is preferred that the mold release agent be applied in sufficient amounts to ensure that substantially all surfaces of the mold are covered with the release agent. Preferably, the coating of the mold release agent is from about 8 to 10 mils thick.

The mold is preferably preheated to reduce the rate of cooling of the molten metal. The mold is preferably heated to a temperature of from about 200° to 300° C. For example, when a silicon carbide/aluminum composite is being cast, the mold is preferably heated to a temperature as stated above.

To avoid premature solidification of the matrix metal in the spout, it is also preferred to preheat the spout before the casting operation. The spout is preferably preheated to at least the melting point of the metal being cast.

The billet, bar, or pig of the composite material to be cast into a tube or other shape is preferably heated from about 40°-70° C. above its melting point before being introduced into the spout or mold. It is preferred to minimize the time the matrix metal is in the molten state to avoid reaction of the reinforcing particles with the matrix metal and/or dissolution of the reinforcing particles in the matrix metal.

The force on the mold is a function of the mold diameter and the RPM of the mold. In casting tubes according to the present invention, it is preferred to apply a centrifugal force to the mixture being cast of from about 80-160 G's.

Tubes fabricated according to the present invention may have a coarse inner surface due to the migration of oxides to the inner surface. In such cases, the inner surface can be machined and/or the surface finished by any conventional technique.

The process of the present invention has the advantage that it produces clean metal (less oxides than P/M product, no sand, gas pockets, or impurities), dense metal (free from shrinkage and porosity), minimal waste of materials, and refined grain size. In addition, multilayer tubes can be fabricated with fixed or graded volume fractions of reinforcing material. In a preferred aspect of the invention, the outer or inner layers of the tube can be clad with a monolithic layer of matrix metal, e.g., aluminum, an alloy of the matrix metal, or a different composite alloy.

The mold can be spun while in any position. In a preferred embodiment, the mold is rotated while in either a vertical or horizontal position. When the process of the present invention is used with a vertically positioned mold, it is preferred to pour the molten matrix metal at or near the center of the spinning vertical mold. It has been found that composite castings produced with a vertical mold according to the present invention have a uniform distribution of reinforcement throughout the matrix metal. In both the horizontal and vertical casting processes, it is preferred to inject the reinforcement into the molten matrix mold as it is poured into the mold.

Figure 2:
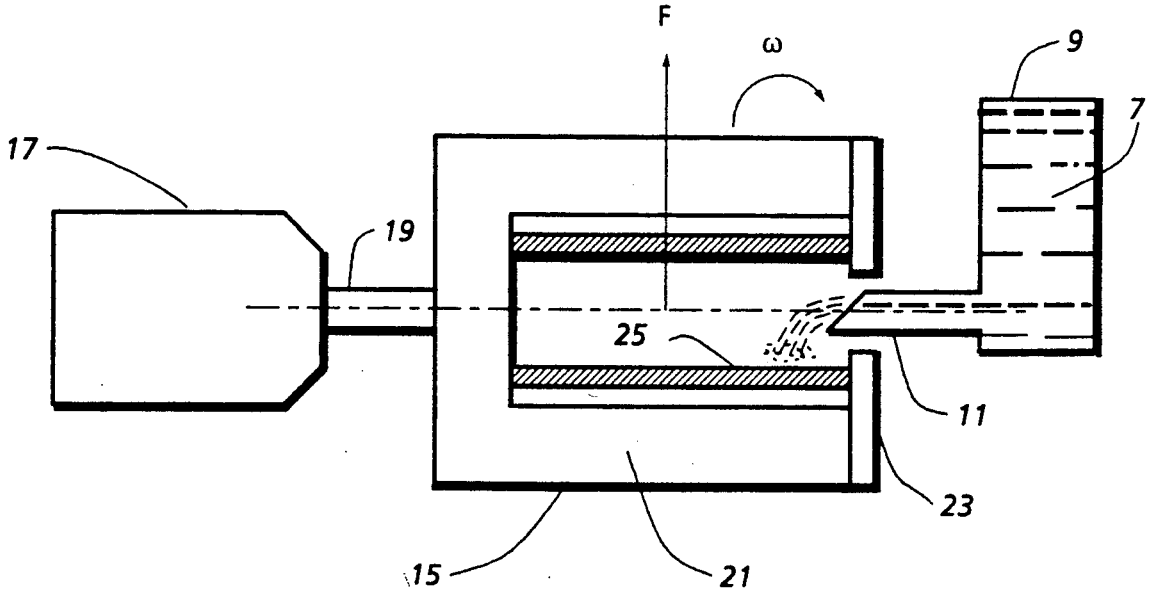
FIG. 2 is a cross-sectional view of a device for spin casting a tube of the composite material.

FIG. 1 is an induction furnace shown general at 1 having controls 3 and containing a crucible 5, formed preferably of a clay bonded graphite, a molten mixture 7 of a matrix metal and reinforcing material. The molten mixture 7 is introduced into a funnel 9 having a trough 11 (FIG. 2). The funnel 9 and trough 11 are preferably coated with a mold release agent (not shown) prior to introducing the molten mixture 7 therein. In a preferred embodiment, the funnel 9 and trough 11 are preheated by conventional means to avoid solidification of the molten metal on the walls thereof. The molten metal 7 discharges from trough 11 into a horizontal rotating spin casting device, shown generally at 15, which includes a variable speed motor 17 coupled by shaft 19 to a rotatable cylindrical mold 21 having an end plate 23. As the mold rotates, a force F, shown as an arrow, is generated, causing the molten mixture to be thrown outwardly against the inside wall of mold 21, thereby forming a tube 25.

Figure 3:
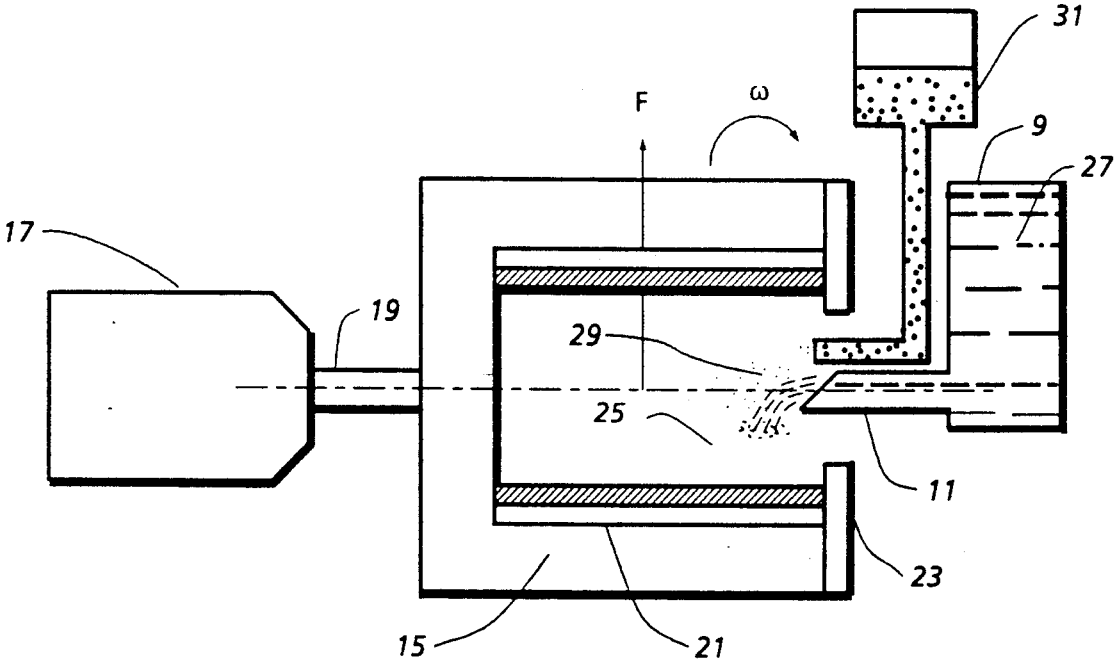
FIG. 3 is a cross-sectional view of the device of FIG. 2 illustrating the additional feature of injecting particulate reinforcing material into the molten matrix metal as it is poured into the spinnable mold.

In a preferred aspect of the present invention, the reinforcing material is added to the matrix metal as it is introduced into the rotating mold. FIG. 3 illustrates this embodiment wherein like components of the apparatus of FIG. 2 are designated with like numerals. In FIG. 3, the matrix metal 27 is introduced into funnel 9 and flows into the mold through trough 11. The particulate reinforcing material (whiskers or particles) 29 in funnel 31 mix with the molten matrix metal 27 as it is poured into mold 21. In a preferred aspect of the present invention, the molten metal is introduced into the mold 21 when it is spinning at predetermined RPM. Any conventional means can be provided to cool the mold 15 to increase the rate of solidification of the cast metal.

Without further elaboration, it is believed that one skilled in the art can, using the preceding description, utilize the present invention to its fullest extent. The following preferred specific embodiments are, therefore, to be construed as merely illustrative and not limitative of the remainder of the disclosure in any way whatsoever.

In the foregoing and in the following examples, all temperatures are set forth uncorrected in degrees Celsius; and, unless otherwise indicated, all parts and percentages are by weight.

The entire texts of all applications, patents, and publications, if any, cited above and below, are hereby incorporated by reference.

EXAMPLES

EXAMPLE 1

A 10 V/O silicon carbide particulate/356 aluminum cast bar stock 3½"×1"×18" long was melted under an argon atmosphere by heating to a temperature of 700°-710° C. Before casting, alumina mold release agent was sprayed to a thickness of approximately of 0.007-0.010" thick onto the surface of a cylindrical mold, chute, and funnel. The mold had an interior diameter of 4" and was 2' long. The mold was rotated from about 900-1000 RPM under an argon atmosphere. Molten silicon carbide/aluminum was poured into the mold through a funnel and chute. A cast tube 4" in diameter and ⅛" thick was removed from the mold after 20-30 seconds. The microstructure of the cast tube was examined and found to have a good distribution of the reinforcement in the absence of shrinkage, porosity, and reaction products.

EXAMPLE 2

Using a procedure similar to Example 1, a multi-layer tube was fabricated. An outer layer of unreinforced aluminum metal was first poured into the mold rotating at from 900-1000 RPM to form a solidified outer layer about 0.062-inches thick. A second reinforcing inner layer was then poured using the silicon carbide/aluminum composite of Example 1. The resultant tube was found to have an excellent bond between the layers with very little migration of silicon carbide particles into the outer aluminum layers.

EXAMPLE 3

A process similar to Example 1 was used. Molten aluminum is poured through the spout and into the spinning mold, while silicon carbide powder 5 to 20 n microns in diameter is blown into the stream of the molten aluminum before it contacts the mold surface. The silicon carbide particles mixed with the matrix aluminum metal and migrated due to the centrifugal forces into the tube wall.

EXAMPLE 4

A process similar to Example 1 is conducted using a vertical spinning mold. The molten mixture is poured into the center of the spinning mold. Utilizing the identical parameters as in Example 1, a cast tube is obtained. Upon examination by micrographic techniques, it is revealed that a uniform distribution of the reinforcement in the matrix metal is obtained when the aspect ratio of the casting, i.e., ratio of length to diameter, is no more than about 3.

The vertical casting process of the present invention can be used to produce symmetrical shapes, such as tubes, and asymmetrical shapes, such as T-joints, gear castings, crosses, etc.

From the foregoing description, one skilled in the art can easily ascertain the essential characteristics of this invention and, without departing from the spirit and scope thereof, can make various changes and modifications of the invention to adapt it to various usages and conditions.

What is claimed is:

1. In a process for the manufacture of a tube or other symmetrical shape from a composite material, the improvement comprising melting a matrix metal selected from the group consisting of aluminum, aluminum alloy, magnesium, a magnesium alloy, copper, a copper alloy, nickel, or a nickel-based alloy containing particulate reinforcing material therein selected from the group consisting of silicon carbide, boron carbide, titanium carbide, graphite, alumina, silicon nitride, and combinations thereof, and introducing the resultant molten mixture into a rotating spin casting mold and cooling the mixture until it solidifies, said molten mixture being cast and solidified before any substantial reaction occurs between the reinforcing material and matrix metal.

2. The process of claim 1, wherein the matrix metal is aluminum, an aluminum alloy, magnesium, a magnesium alloy, copper, a copper alloy, nickel, or a nickel-based alloy.

3. The process of claim 1, wherein the reinforcing material is silicon carbide, boron carbide, titanium carbide, graphite, alumina, silicon nitride, and combinations thereof.

4. The process of claim 1, wherein the mold is cylindrical.

5. The process of claim 1, wherein the mold is coated with a layer of a mold release agent.

6. The process of claim 1, wherein the mold release agent is alumina or graphite.

7. The process of claim 1, wherein the mold release agent is from about 8-10 mils thick.

8. The process of claim 1, wherein the matrix metal containing particulate reinforcement material is in the form of a bar, billet, or pig which is melted in an induction furnace or swing coil furnace under an argon blanket.

9. The process of claim 8, wherein the molten mixture is immediately cast and solidified before any substantial reaction occurs between the reinforcing material and the molten matrix metal.

10. The process of claim 1, wherein the reinforcing material constitutes from about 7-40 volume percent of the composite material.

11. The process of claim 1, wherein the reinforcing material constitutes from 10-20 volume percent of the composite material.

12. The process of claim 1, wherein the mold is in a vertical position and a stream of the resultant molten mixture is introduced at or near the center of the mold.

13. The process of claim 1, wherein the matrix metal is aluminum, wherein the reinforcing material is silicon carbide particles or whiskers, wherein the mixtures contains from about 7-40 percent by volume of silicon carbide, and the mixture is subjected to a centrifugal force of 80-160 G's.

* * * * *